United States Patent [19]

Mazeika

[11] 4,378,646

[45] Apr. 5, 1983

[54] COLLAPSIBLE WORK HOLDING STRUCTURE

[75] Inventor: Albert Mazeika, Tucson, Ariz.

[73] Assignee: Needlepointer, Tucson, Ariz.

[21] Appl. No.: 213,411

[22] Filed: Dec. 5, 1980

[51] Int. Cl.[3] ..... D05C 1/04; A47B 97/04

[52] U.S. Cl. ..... 38/102; 38/102.2; 38/102.4; 108/43; 248/444

[58] Field of Search ..... 108/43; 289/16.5, 18.1; 38/102, 102.1, 102.2, 102.4, 102.9; 248/444

[56] References Cited

U.S. PATENT DOCUMENTS

| | | | |
|---|---|---|---|
| 3,730,077 | 5/1973 | Selden | 108/43 |
| 3,899,164 | 8/1975 | Newman | 289/18.1 |
| 3,906,648 | 9/1975 | Bard | 108/43 X |
| 4,124,237 | 11/1978 | Catania | 289/16.5 |
| 4,292,748 | 10/1981 | Miller | 108/43 |

*Primary Examiner*—Louis Rimrodt

*Attorney, Agent, or Firm*—James E. Brunton

[57] ABSTRACT

A collapsible work holding structure adapted to position a work piece over a person's lap while the person is seated in a chair or the like. The structure can be easily folded into a compact unit without the necessity of removing the work piece and can be readily adjusted to position the work piece at various heights and angles to optimize accessibility to the work.

8 Claims, 5 Drawing Figures

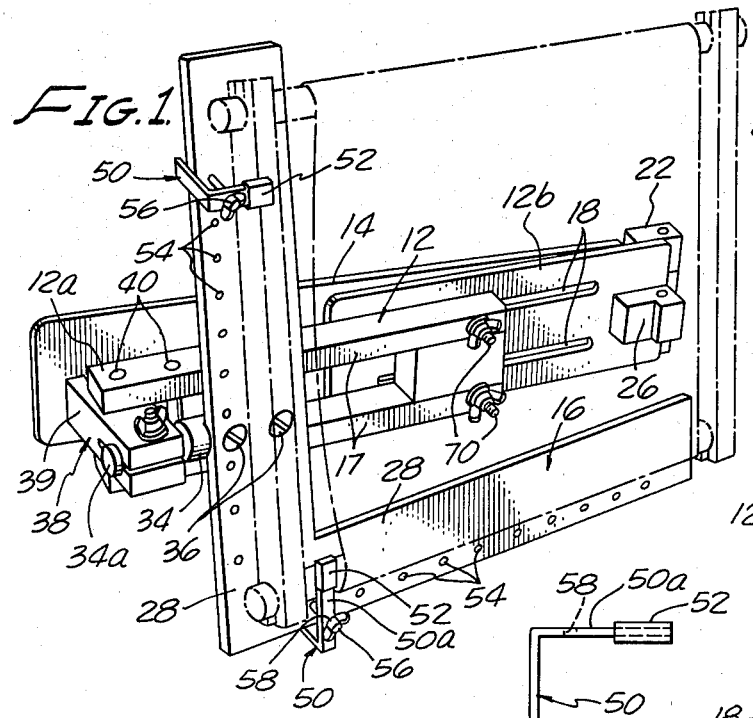
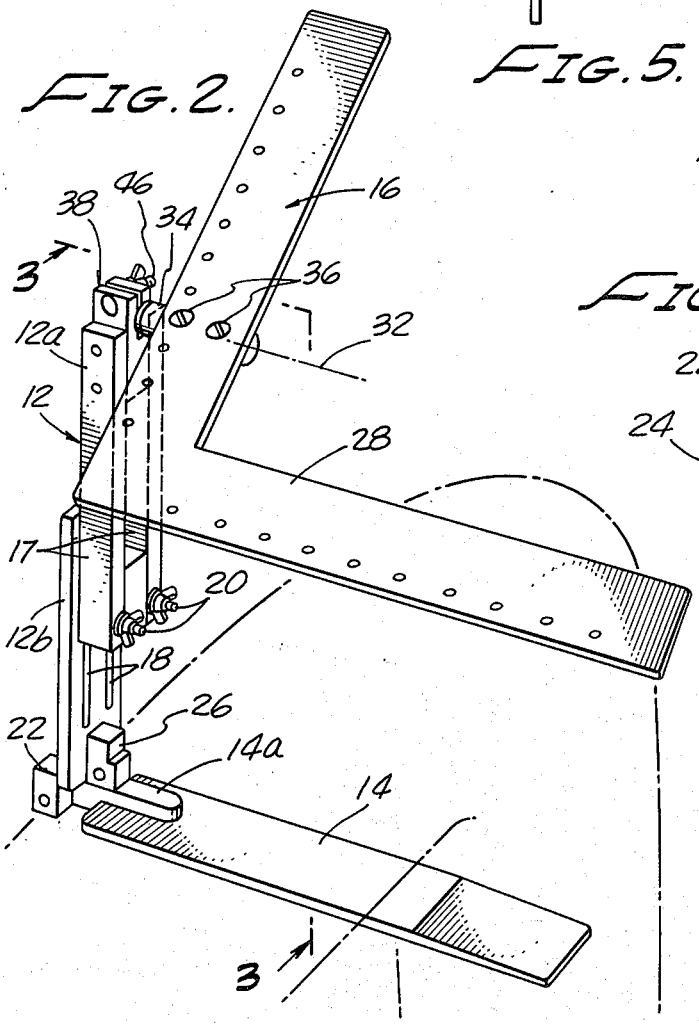
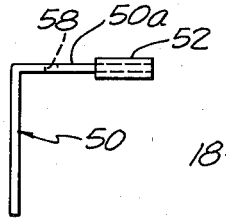
FIG. 5.
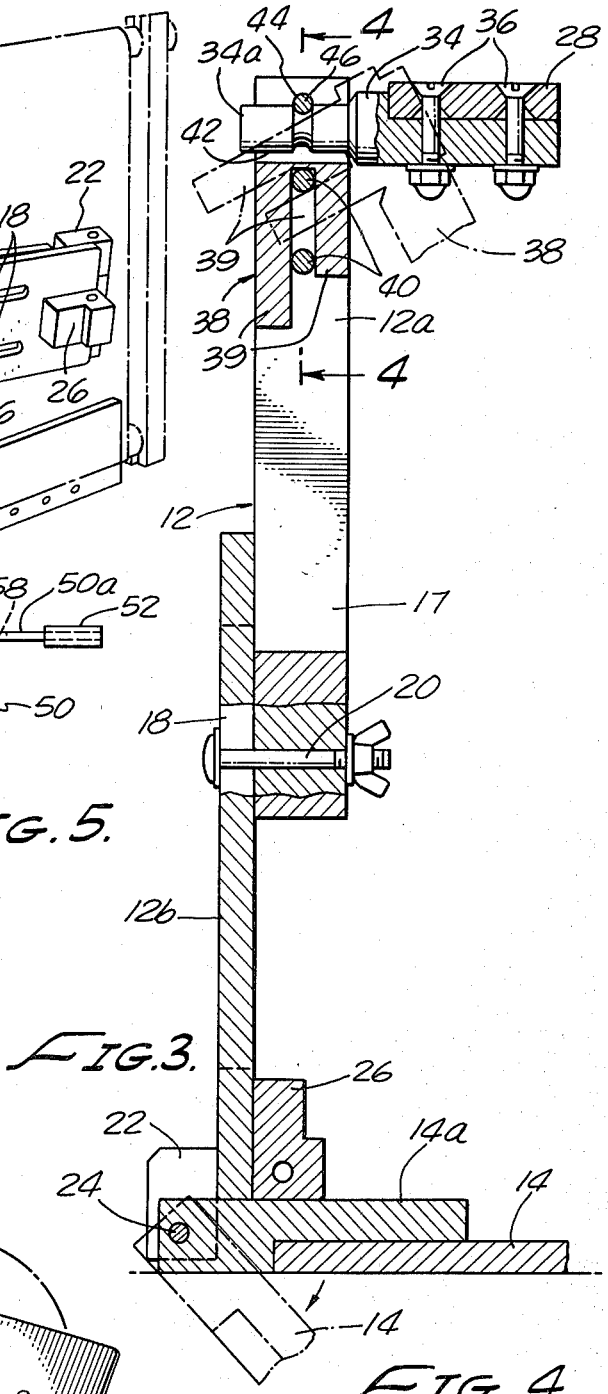
FIG. 3.
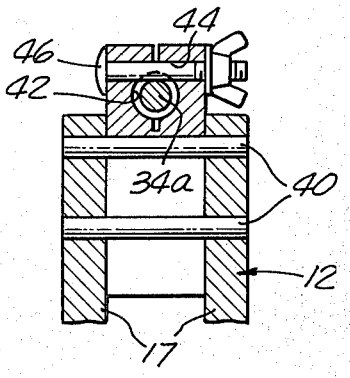
FIG. 4.

COLLAPSIBLE WORK HOLDING STRUCTURE

BACKGROUND OF THE INVENTION

1. Field of the Invention

The present invention relates generally to work holding structures and more particularly to a novel, collapsible device adapted to position work pieces such as needlework and the like over a person's lap while the person is in a seated position.

2. Discussion of the Prior Art

With the growing popularity of needlework, embroidery and the like handycrafts there has developed a need for specially designed structures for supporting the work over a person's lap in a manner such that it is comfortably positioned and readily accessible. To meet this need several types of foldable tables and trays have been suggested. Generally, however, these devices are quite large and often are cumbersome to use. Further, such devices typically do not lend themselves to ease of portability.

In addition to the "TV tray" and "bedside table" type supporting devices, several work holding devices particularly adapted for holding needlepoint hoops and frames have been developed. One of these devices is marketed under the name "Fanny Frame" and another is described in U.S. Pat. No. 3,730,077. These devices represent the most pertinent art known to the present inventor.

SUMMARY OF THE INVENTION

It is an object of the present invention to provide a work positioning structure which can be easily folded into a compact unit for storage or portability without the necessity of removing the work therefrom and can be readily erected into a highly stable, work supporting configuration.

It is another object of the invention to provide a structure of the aforementioned character which can be easily adjusted to position the work at various heights and angles to optimize accessibility to the work. No tools are needed to fold or adjust the device.

It is still another object of the invention to provide a structure of the character described which is readily adaptable for use by either right or left handed persons.

It is a further object of the invention to provide a structure as described in the previous paragraphs which embodies no metal hinges to scratch or snag furniture and one which can be simply and inexpensively manufactured.

These and other objects of the invention are achieved by a collapsible work positioning structure comprising a first normally vertically extending member; a second member adapted to rest upon a seating surface and extend beneath a person seated thereon, the second member being pivotally connected to the first member proximate one end thereof and being adapted to pivot relative to the first member through an angle of about 270° from a work position wherein the members are substantially perpendicular to a transport position wherein the members extend generally parallel to each other; a work holding assembly operable connected to the first member proximate the other end thereof, the assembly comprising a pivotable portion connected to the first member and being adapted to pivot from an aligned work position into a transport position, a work holding member rotatably connected to the pivotable portion for rotation about a horizontal axis; and locking means for releasably locking the pivotable portion and the first member in an aligned work position.

BRIEF DESCRIPTION OF THE DRAWINGS

FIG. 1 is a perspective view of the work positioning structure of the invention illustrating its appearance in a collapsed configuration for storage or transport.

FIG. 2 is a perspective view of the work positioning structure illustrating its appearance in an erected, work piece supporting configuration.

FIG. 3 is a side elevational view, partly in cross-section to show details of construction.

FIG. 4 is a fragmentary cross-sectional view taken along lines 4—4 of FIG. 3.

FIG. 5 is a side elevational view of a typical clamping bracket used for clamping the work piece to the structure.

DESCRIPTION OF ONE FORM OF THE INVENTION

Referring to the drawings and particularly to FIGS. 1 through 3, the collapsible work positioning structure of the invention comprises a first normally vertically extending member 12, a second member 14 adapted to rest upon a seating surface and extend beneath a person seated thereon, and a work holding assembly 16 rotatably mounted with respect to first member 12. As best seen in FIG. 2, member 12 is constructed in two parts, an upper part **12*a* having spaced apart upwardly extending leg portions 17 and a lower portion 12*b*. Lower portion 12*b* is provided with a pair of spaced apart slots 18 adapted to receive the shank portion of elongated threaded fasteners 20 carried by upper portion 12*a*. Fasteners 20 which comprise part of the interconnecting means of the invention, extend through bores provided in upper member 12*a* and protrude through slot 18. With this arrangement, by loosening the wing nuts carried on the inboard end of fasteners 20, portions 12*a* and 12*b* of member 12 can be moved relative to one another to adjust the overall vertical height of first member 12**.

Second member, or seat portion, 14 is pivotally connected to first member 12 proximate one end thereof and is adapted to pivot relative to member 12 through an angle of about 270° from an erected, work supporting position as shown in FIG. 2 wherein the members are substantially perpendicular, to a transport, or storage position as shown in FIG. 1 where the members extend generally parallel to each other.

Referring particularly to FIGS. 2 and 3, second member 14 can be seen to include a rearwardly extending, stepped, tongue portion **14*a* adapted to be closely received between two spaced apart blocks 22 affixed to the rear, or back surface of lower portion of 12*b* of member 12. As illustrated by the phantom lines in the lower portion of FIG. 3, member 14 is adapted to pivot in the direction of the arrow about an axis defined by a pivot pin 24 which extends through blocks 22 and portion 14*a* of member 14. The unique design of the apparatus permits member 14 to be pivoted through an angle of about 270° into the folded position shown in FIG. 1. When the device is in a stable erected position as shown in FIG. 3, a stop means as in the form of a block 26 which is attached to the front face of portion 12*b* of member 12 functions to hold members 12 and 14** in a substantially perpendicular relationship.

The work holding assembly 16 comprises a work holding member or frame 28 and interconnecting means for interconnecting the frame and the first member 12 in a manner so that the frame is rotatable about an axis 32 (FIG. 2) which extends substantially perpendicular to the plane of the first member 12. In the form of the invention shown in the drawings, work holding member 28 is generally "L" shaped and the interconnecting means comprises a generally cylindrically shaped member 34 to which the "L" shaped frame is removably connected by flat head fastening bolts 36.

Also forming a part of the interconnecting means of this embodiment of the invention is a pivotal intermediate portion 38 disposed between the spaced apart legs 17 of first member 12. Pivotable portion 38 is provided with a pair of spaced apart downwardly extending legs 39 (FIG. 3) which are adapted to straddle a pair of dowel pins 40 (FIG. 4) which extend between the spaced apart upper leg portions of member 12. Dowel pins 40 and legs 39 comprise the locking means of the invention for releasably locking the pivotable portion and member 12 in an aligned work position. With the arrangement shown in the drawings, portion 38 is vertically movable with respect to member 12 and when in a raised position is pivotable about upper dowel pin 40 in the manner illustrated by the phantom lines of FIG. 3. As shown in FIG. 1, when member 38 is fully pivoted into its collapsed position, it extends slightly past a perpendicular position with respect to member 12.

As best seen in FIG. 4, pivotable portion 38 is provided with a generally cylindrical bore 42 which extends therethrough and is adapted to closely receive the reduced diameter end portion 34*a* of cylindrical member 34. As also indicated in FIG. 4, portion 38 is slotted and provided with a bore 44 extending transversely to bore 42. Bore 44 is adapted to receive an elongated, threaded fastener means 46. When the wing nut of fastener means 46 is tightened, the slotted portion of member 38 grips member 34 so as to prevent rotation thereof within bore 42. Conversely, by loosening the wing nut, cylindrical member 34, along with frame 28, can be freely rotated with respect to member 12 through an angle of 360°. With this arrangement, the work piece supported by frame 28 can be positioned at various angles with respect to the user and also can be rotated so that the reverse side of the work can be made readily visible to the user. This feature is particularly advantageous when the work positioning structure is used to support needlepoint frames and the like.

To securely clamp the work piece, as for example a needlepoint frame, onto the device of the invention, member 28 is provided with adjustable securement means, here comprising "L" shaped clamps, or brackets 50 (FIGS. 1 and 5). Brackets 50 are preferably made of metal, or rigid plastic and are provided with non-mar end portions 52 which may be constructed of soft rubber or the like. As best seen in FIG. 1, member 28 is provided with a plurality of spaced apart apertures 54 extending along the length of the legs thereof. Apertures 54 are adapted to receive threaded fasteners 56 which also extend through apertures 58 provided in brackets 50. With this arrangement brackets 50 can be appropriately positioned along the legs of member 28 to accommodate work pieces of various sizes and with the work pieces positioned beneath the upper legs 50*a* of the brackets, it can be securely clamped against the upper surface of member 28 by tightening the wing nuts of fasteners 56.

Various materials can be used to fabricate the component parts of the structure of the invention including wood, plastic, metal and composite materials. However, an all wood version of the device has the advantage of protecting the furniture upon which the user is seated from being scratched or marred by the device.

Operation

In setting up the apparatus for use, member 28 can be affixed to member 34 for use by either a right or left handed person depending upon which side of the member is placed in engagement with member 34. The device is erected from the collapsed position shown in FIG. 1 to the working position shown in FIG. 2 by first pivoting member 14 about pivot pin 24 through an angle of about 270°. In this configuration, block 26 prevents further pivotal movement and holds members 12 and 14 in a substantially perpendicular relationship. Next, the work holding assembly 16 is provided about upper dowel 40 to a position wherein pivotable portion 38 is aligned with portion 12*a* of member 12. When so aligned, portion 38 will move downwardly so that legs 39 straddle dowel pins 40 thereby preventing pivotal movement of assembly 16 relative to member 12. By loosening the wing nut of fastener 46 (FIG. 4) cylindrical member 34 can be rotated within bore 42 about axis 32 to position frame 28 at the desired angle relative to the user. Retightening of the wing nut will securely clamp frame 28 against inadvertant rotational movement.

With the structure erected in the manner shown in FIG. 2, brackets 50 can be appropriately located within apertures 54 provided along the legs of frame 28. Next the work piece is positioned beneath the upper legs 50 of the brackets and the wing nuts of fasteners 56 are snugged down to securely clamp the work against frame 28.

When the user wishes to collapse the device, the steps just described are reversed. It is to be noted, however, that due to the unique deisgn of the structure, the work piece need not be removed prior to folding the device unless removal thereof is desired by the user. It is also possible, if desired, to remove the work piece along with frame 28 from member 12 by simply loosening the wing nut of fastener 46 and withdrawing cylindrical member 34 from bore 42.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A collapsible work holding structure comprising:

(a) a first normally vertically extending member;

(b) a second member adapted to rest upon a seating surface and extend beneath a person seated thereon, said second member being pivotally connected to said first member proximate one end thereof and being adapted to pivot relative to said first member through an angle of about 270° from a work position wherein said members are substantially perpendicular to a transport position wherein said members extend generally parallel to each other;

(c) a work holding assembly operably connected to said first member proximate the other end thereof, said assembly comprising:

(1) a pivotable portion connected to said first member and being adapted to pivot from an aligned work position into a transport position;

(2) a work holding member rotatably connected to said pivotable portion for rotation about a horizontal axis, said work holding member comprising a frame having at least two perpendicularly extending legs and including a generally cylindrically shaped member extending substantially at right angles to one of said legs; and (d) locking means for releasably locking said pivotable portion and said first member in an aligned work position.

2. A work holding structure as defined in claim 1 in which said work holding member comprises a frame having at least two perpendicularly extending legs and includes a generally cylindrically shaped member extending substantially at right angles to one of said legs.

3. A work holding structure as defined in claim 1 in which said first member comprises two parts and includes interconnecting means for slidably interconnecting said parts together whereby the overall length of said members can be adjusted.

4. A work holding structure as defined in claim 1 in which said first member includes a pair of spaced apart legs adapted to carry said pivotable portion of said work holding assembly therebetween.

5. A work holding structure as defined in claim 4 including a pivot pin extending between said spaced apart legs of said first member, said pin being adapted to pivotally carry said pivotable portion of said work holding assembly.

6. A work holding structure as defined in claim 5 in which said pivotable portion of said work holding assembly is provided with a slot adapted to closely receive said pivot pin whereby said pivotable portion is movable vertically relative to said first member.

7. A work holding structure as defined in claim 6 in which said locking means comprises at least one locking pin extending between said spaced apart legs of said first member said locking pin being receivable within the slot formed in said pivotable portion of said work holding assembly.

8. A collapsible work positioning structure comprising:

(a) a first normally vertically extending member having a pair of spaced apart legs proximate its upper end;

(b) a second member, adapted to rest upon a seating surface and extend beneath a person seated thereon, said second member being pivotally connected to said first member proximate one end thereof and being adapted to pivot relative to said first member through an angle of about 270° from a work position wherein said members are substantially perpendicular to a transport position wherein said members extend generally parallel to each other;

(c) a work holding assembly operably connected to said first member proximate the other end thereof, said assembly comprising:

(1) a pivotable portion disposed between said spaced apart legs of said first member and being pivotable therebetween about a substantially horizontally extending axis, said pivotable portion having a cylindrical bore therethrough proximate the upper end thereof;

(2) a substantially cylindrically shaped member rotatably receivable within said cylindrical bore; and (3) a work supporting frame removably connected to said cylindrically shaped member said frame having two perpendicularly extending legs each provided with a plurality of spaced apart apertures;

(d) locking means for locking said pivotable portion of said work holding means against pivotal movement relative to said first member; and (e) clamping means for clamping said cylindrically shaped member against rotation within said cylindrical bore.

* * * * *